US006013975A

United States Patent [19]

Gijrath

[11] Patent Number: 6,013,975

[45] Date of Patent: Jan. 11, 2000

[54] COLOR DISPLAY TUBE HAVING A SHADOW MASK

[75] Inventor: Johannes H. N. Gijrath, Valkenswaard, Netherlands

[73] Assignee: U.S. Philips Corporation, New York, N.Y.

[21] Appl. No.: 08/128,622

[22] Filed: Sep. 28, 1993

[30] Foreign Application Priority Data

Sep. 29, 1992 [NL] Netherlands ..... 9201675

[51] Int. Cl.[7] ..... H01J 29/07

[52] U.S. Cl. ..... 313/407; 313/404

[58] Field of Search ..... 313/407, 404, 313/402

[56] References Cited

U.S. PATENT DOCUMENTS 4,146,816 3/1979 Morrell ..... 313/407
4,437,036 3/1984 Ragland, Jr. ..... 313/407

FOREIGN PATENT DOCUMENTS 2000904 1/1979 United Kingdom ..... H01J 29/07

*Primary Examiner*—Vip Patel
*Assistant Examiner*—Michael Day
*Attorney, Agent, or Firm*—John C. Fox

[57] ABSTRACT

A colour display tube 1 has a shadow mask 12 in a supporting frame 20. The supporting frame comprises at least two sides 22 which bend when the temperature increases. This causes the distance between the shadow mask and the display screen to change. An improvement of "overall doming" is possible.

12 Claims, 5 Drawing Sheets

20
12
22
24
25
29
32
33
41
41a
41b
42
43
43a
43b
45
C
D

COLOR DISPLAY TUBE HAVING A SHADOW MASK

The invention relates to a colour display tube comprising an electron gun for generating electron beams and comprising a quadrilateral supporting frame which is suspended in front of a display screen and to which a shadow mask is secured.

BACKGROUND OF THE INVENTION

Colour display tubes are used, for example, in television receivers and monitors.

A quadrilateral supporting frame is a frame having two pairs of opposed sides.

Colour display tubes of the type described above are known. The shadow mask contains a large number of apertures to allow passage of electron beams and extends approximately parallel to the display screen. After the electron beams have passed through the apertures in the shadow mask they impinge on the display screen. The display screen contains a phosphor pattern. The location where electron beams impinge on the display screen is governed, inter alia, by the position of the apertures of the shadow mask relative to the phosphor pattern of the display screen. As approximately 80% of the electrons generated by the electron gun impinge on the shadow mask, the temperature of the shadow mask increases in operation. This causes the shadow mask to expand. In general, the temperature increase at the edge is smaller than at the center of the shadow mask. This difference in temperature causes the shadow mask to bulge. As a result thereof, displacements of the electron beams relative to the phosphor pattern may occur, which displacements will hereinafter be referred to as "landing displacements". Landing displacements taking place when the shadow mask is uniformly irradiated are referred to as "overall doming". Landing displacements also occur when the ambient temperature changes; this phenomenon is termed "ambient doming". By using suspension means, a supporting frame can be suspended, in known manner, in front of the display screen in such a way that the distance between the supporting frame and the display screen is temperature-dependent. Suspension means which can suitably be used for this purpose may comprise, for example, bimetal springs or another suspension construction which move or moves the supporting frame toward the display screen when the temperature increases. In this manner, "overall doming" can be reduced.

A reduction of the landing displacements has a favourable effect on picture quality.

SUMMARY OF THE INVENTION

It is an object of the invention to provide, inter alia, a colour display tube of the above-mentioned type in which landing displacements and, in particular, overall doming are reduced.

To this end, a colour display tube in accordance with the invention is characterized in that at least one pair of oppositely located sides of the supporting frame bend as the temperature increases, and in that the sides and the shadow mask are interconnected in such a manner that as a result of the bending the distance between the shadow mask and the display window changes.

The invention is, inter alia, based on the insights that the supporting frame need not be a rigid construction and that bending of a side of the supporting frame as a result of an increase in temperature may cause the distance between the shadow mask and the display screen to change. Within the scope of the invention, the expression "bending of a side" is to be understood to mean that the relevant side bends in such a manner that the center of the side is displaced relative to the corners of the supporting frame in a direction transversely to the plane of the shadow mask. In a colour display tube according to the invention, a change of the distance between the shadow mask and the display screen may be composed of a change caused by the bending of the sides and a change caused by the manner in which the supporting frame is suspended. By virtue thereof, the distance between the shadow mask and the display window can be more accurately controlled than in the case where the distance is determined only by suspension means. In particular the beam displacement near the center of the above-mentioned sides can be accurately controlled and, hence, particularly overall doming be reduced. Preferably, the deflection is elastic.

An embodiment of the colour display tube according to the invention is characterized in that each of the sides of the supporting frame has a thermal expansion which differs from that of the shadow mask, each of the sides is connected to the shadow mask in at least two connection points which points are situated on either side of a centreline through the side extending transversely to the plane of the shadow mask and which points are situated in a plane which is approximately parallel to the shadow mask, each of said sides of the supporting frame exhibiting a weakened portion between the two above-mentioned points, whereby the side is bendable in a direction transversely to the plane of the shadow mask.

As a result of the bending of the sides, the two above-mentioned points and the shadow mask connected to these points move in a direction transversely to the plane of the shadow mask. Within the framework of the invention, the plane of the shadow mask is considered to be the plane tangent to the center of the shadow mask. This embodiment of the invention is, inter alia, based on the insight that a difference in thermal expansion between the sides and the shadow mask can be used so that the sides of the supporting frame bend when the temperature increases.

In another embodiment, elastic bending of the sides is brought about by a connection element having a different coefficient of expansion, which element is situated between each of the sides of the supporting frame and the shadow mask.

Different coefficient of expansion means different from the coefficient of expansion of the relevant side of the supporting frame.

This embodiment has the advantage that no conditions are imposed on the difference in coefficients of expansion between the supporting frame and the shadow mask. The supporting frame and the shadow mask may be made of the same material.

In an embodiment, the weakened portion is formed by a slit in the center of the side, and a hinged joint is located at one end of the slit at a distance from the plane through the connection points.

This is a simple embodiment of a bendable side.

In an embodiment of the display tube according to the invention, the shadow mask and the side are further interconnected on either side of said centreline and at some distance from the connection points by means of flexible connections.

By virtue thereof, no thermal stresses occur in the shadow mask at the location of the flexible connections when the temperature increases. The flexible connections result in an improved fixation of the shadow mask in the supporting frame. Yet another embodiment of the display tube according to the invention is characterized in that the flexible connections are suitable for moving the shadow mask relative to the side in a direction transversely to the plane of the shadow mask.

The above-mentioned sides may be two of the four sides of the supporting frame but, preferably, they include all four sides of the supporting frame. In the case of a colour display tube having a phosphor pattern containing a number of approximately parallel phosphor lines, preferably, at least the sides extending parallel to the phosphor lines are bendable. It is noted, that colour display tubes are known from, inter alia, European Patent Application EP 145.570 in which a shadow mask is suspended in a rigid supporting frame by means of bimetals. Such bimetals enable a relative movement of the shadow mask relative to the supporting frame. Such a construction, however, is complex and expensive. The sides of the supporting frame are rigid.

DESCRIPTION OF THE DRAWING FIGURES

These and other aspects of the invention will be explained in greater detail by means of an exemplary embodiment of an inventive display tube and with reference to the accompanying drawings, in which FIG. 1*a* is a sectional view of a display tube;

FIG. 1*b* schematically shows landing displacements;

Figures 5A, 5B, 5C:
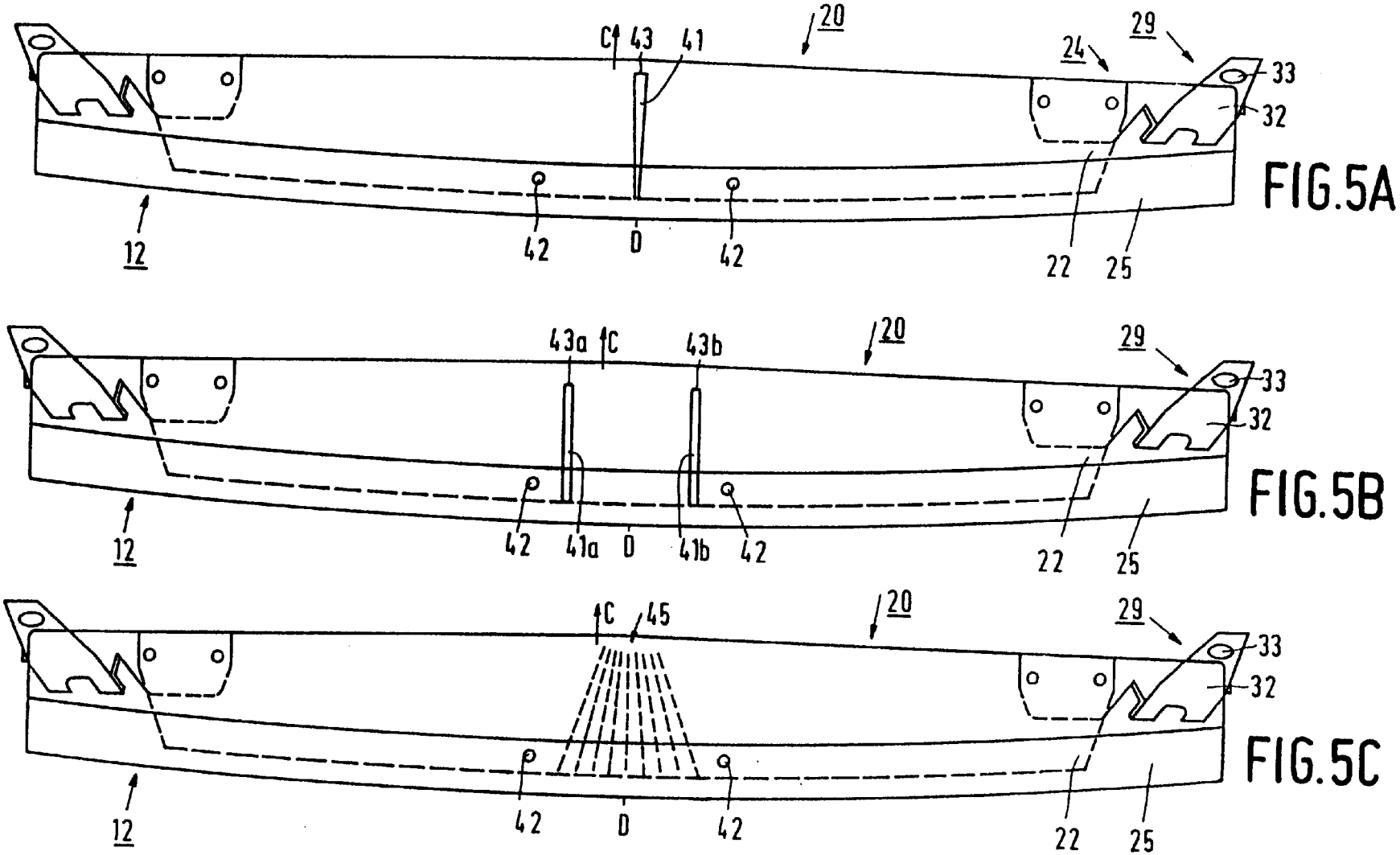
Figure 6:
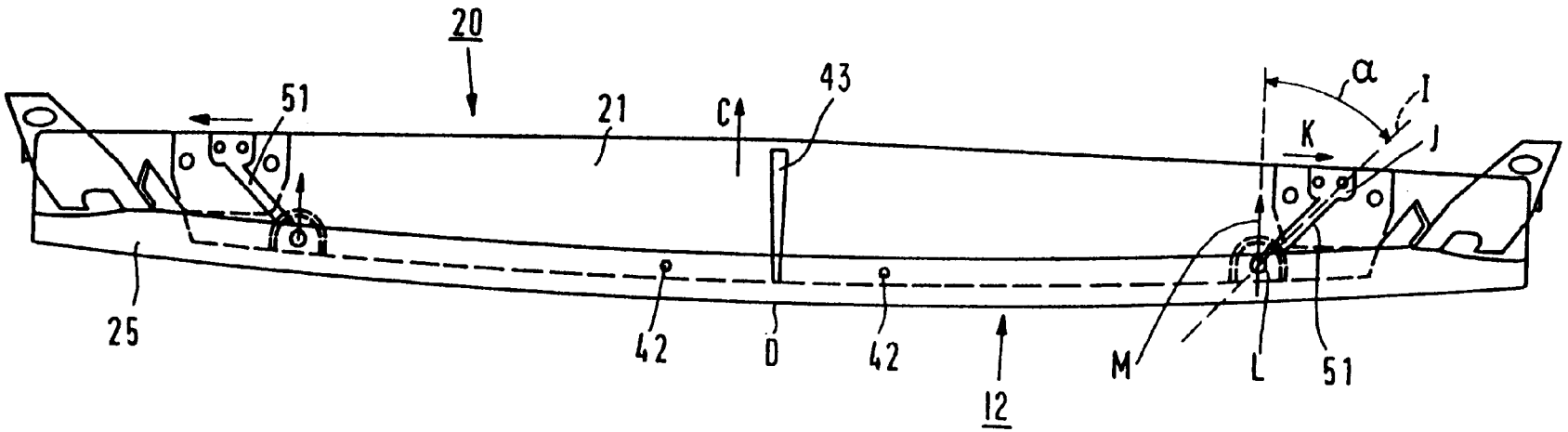
Figure 7:
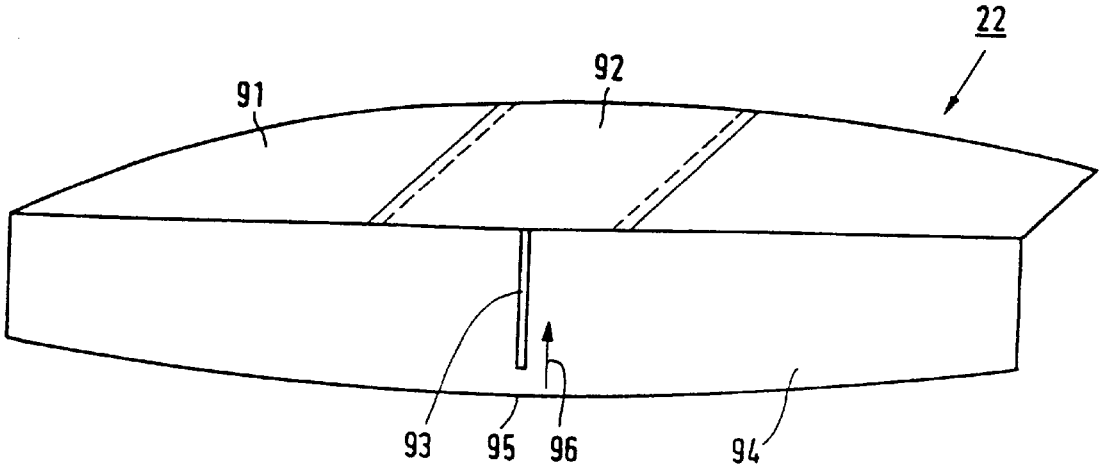
Figure 8:
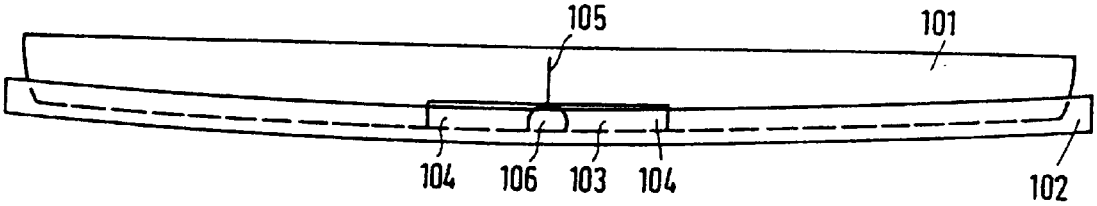
Figure 9:
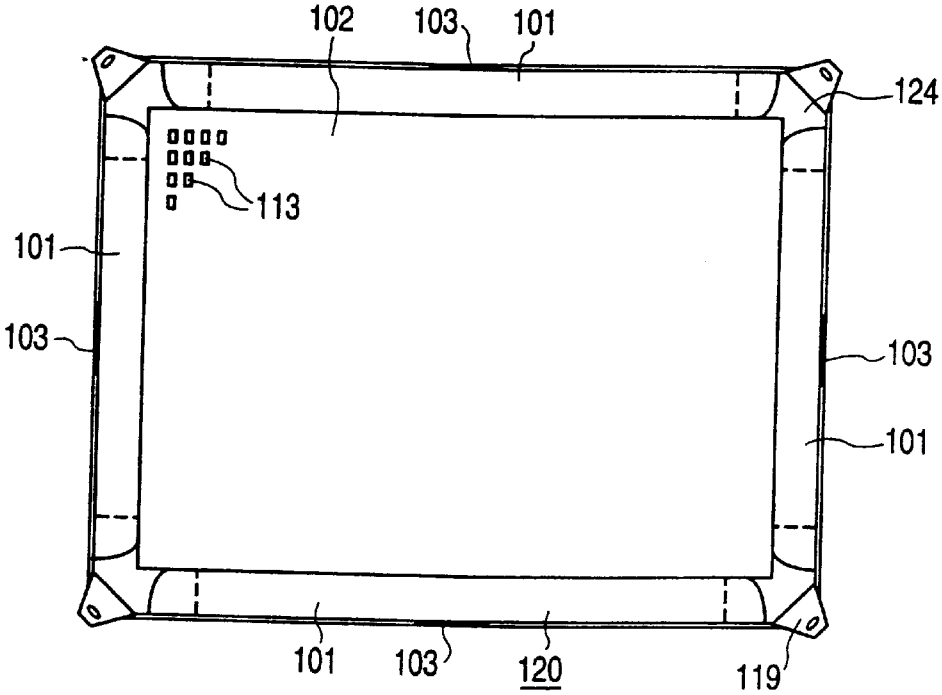

FIGS. 5*a*, 5*b* and 5*c* are elevational views of a detail of embodiments of display tubes according to the invention;

FIGS. 6, 7 and 8 show a detail of a further embodiment of a display tube according to the invention; and FIG. 9 shows a front view of a support frame with a shadow mask according to the present invention in an embodiment, such as in FIG. 8.

The Figures are not drawn to scale. In the Figures, corresponding parts generally bear the same reference numerals.

DESCRIPTION OF THE INVENTION

Figure 1A:
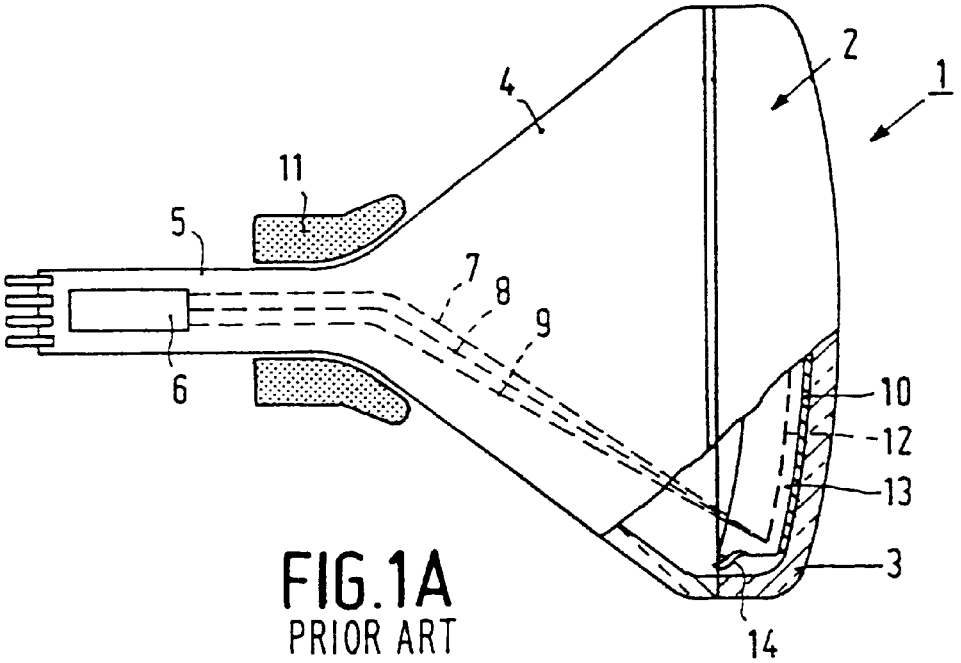
FIG.1A PRIOR ART

A colour display tube (FIG. 1*a*) has an evacuated envelope 2 comprising a display window 3, a cone portion 4 and a neck 5. In the neck 5 there is provided an electron gun 6 for generating three electron beams 7, 8 and 9. A display screen 10 is situated on the inside of the display window. The display screen 10 has a pattern of phosphor elements luminescing in red, green and blue. On their way to the display screen 10, the electron beams 7, 8 and 9 are deflected across the display screen 10 by means of deflection unit 11 and pass through a shadow mask 12 which is arranged in front of the display window 3 with the shadow mask comprising a thin plate having apertures 13. The shadow mask is suspended in the display window by means of suspension means 14. The three electron beams 7, 8 and 9 pass through the apertures 13 of the shadow mask at a small angle and, consequently, each electron beam impinges only on phosphor elements of one colour.

Figure 1B:
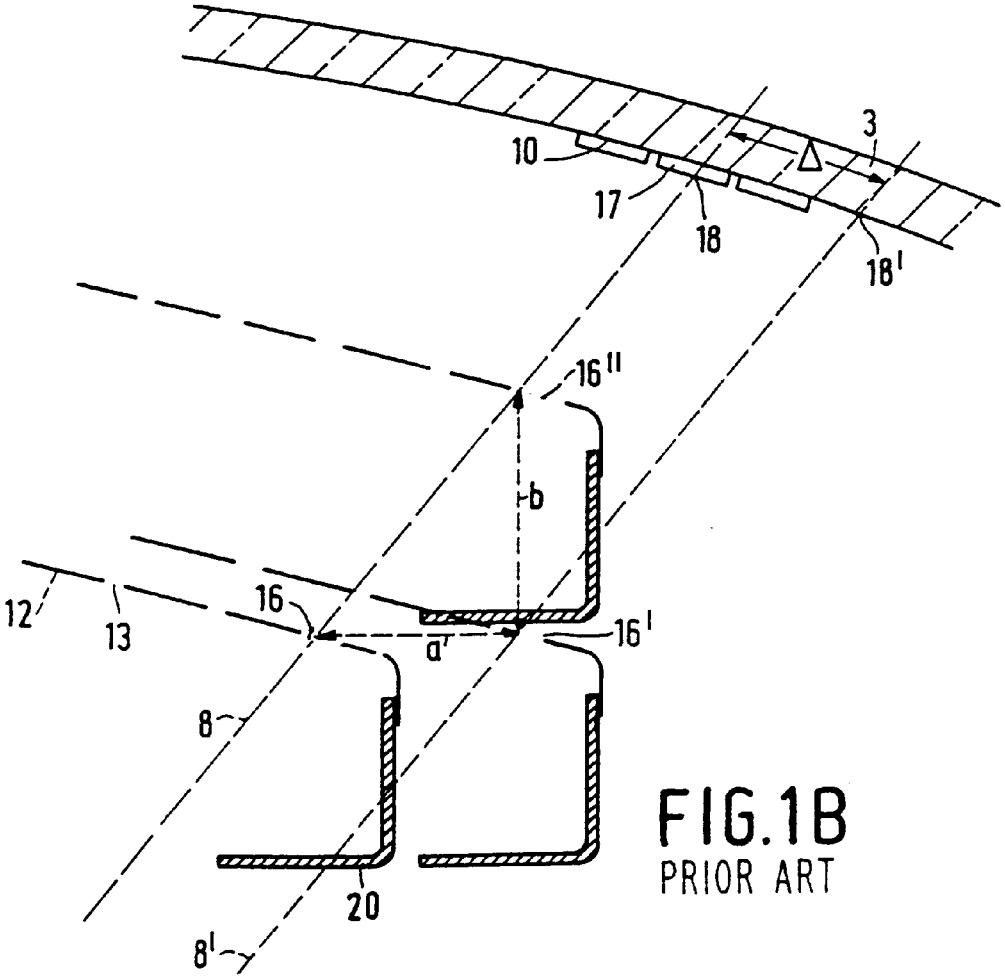
FIG.1B PRIOR ART

FIG. 1*b* diagrammatically shows landing displacements. When the colour display tube is put into operation, electron beam 8 passes through an aperture 16 of the shadow mask 12 and impinges on phosphor 17 of display screen 10 on display window 3 at point 18. The shadow mask is secured to a supporting frame 20. The temperature of the shadow mask increases because approximately 80% of the electrons impinge on the shadow mask. This causes the shadow mask to expand. The aperture 16 is displaced for a distance a to a position indicated in FIG. 1*b* by 16'. The electron beam 8' then impinges on point 18' on the display screen, which point is displaced for a distance Δ relative to point 18. Such distance Δ is termed the beam displacement. The landing displacement can be reduced by providing the colour display tube with means for moving the shadow mask and thus also aperture 16' toward the screen (to a new position indicated by aperture 16") for a distance b. Landing displacements caused by a uniform shadow mask temperature can be compensated in this manner. However, when the shadow mask is subjected to a uniform load, the temperature is not uniform throughout the shadow mask. Instead a temperature gradient occurs. This causes the mask to bulge. This results in an additional landing displacement (in a direction opposite to the landing displacement distance Δ shown in FIG. 1*b*). The overall landing displacement caused by uniform irradiation of the shadow mask, also termed "overall doming", is the sum of the landing displacements caused by expansion of the shadow mask and bulging of the shadow mask, minus the correction resulting from the application of means for reducing the landing displacements.

Figure 2:
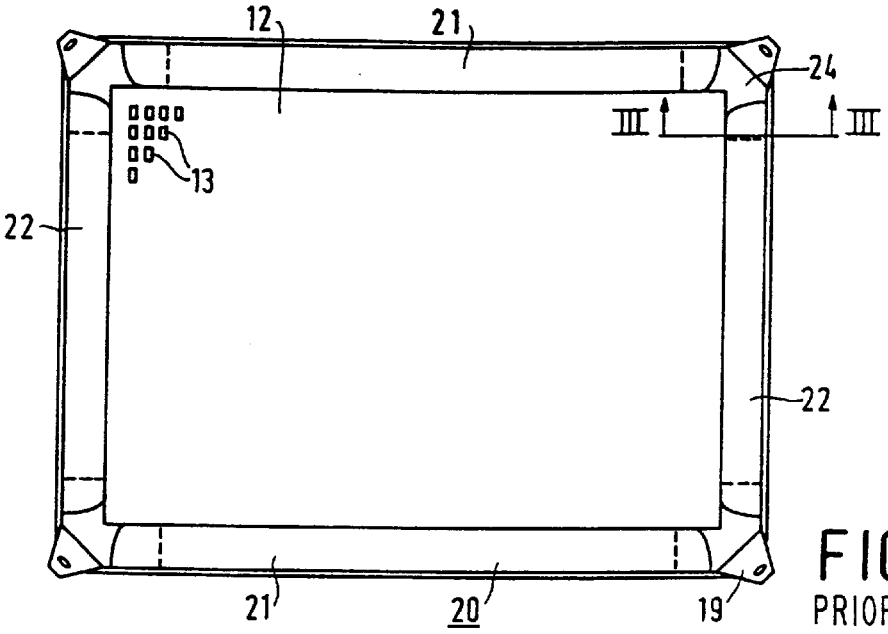
FIG.2 PRIOR ART
FIG. 2 is a front view of a shadow mask with a supporting frame.
Figure 3:
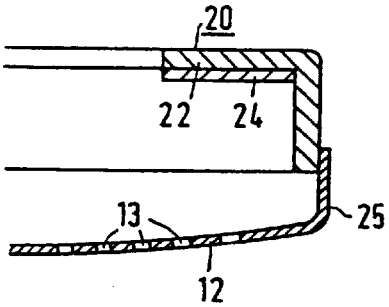
FIG.3 PRIOR ART
FIG. 3 is a sectional view of a shadow mask with a supporting frame.

FIG. 2 is a front view of a shadow mask with a supporting frame. The shadow mask 12 comprises a thin metal plate whose central part is provided with a large number of apertures 13. The shadow mask is secured in a supporting frame 20. The supporting frame 20 comprises four sides 21 and 22 which are interconnected by corner elements 24. The shadow mask 12 has an edge 25 shown in FIG. 3 which is a sectional view taken on the line III—III.

Figure 4:
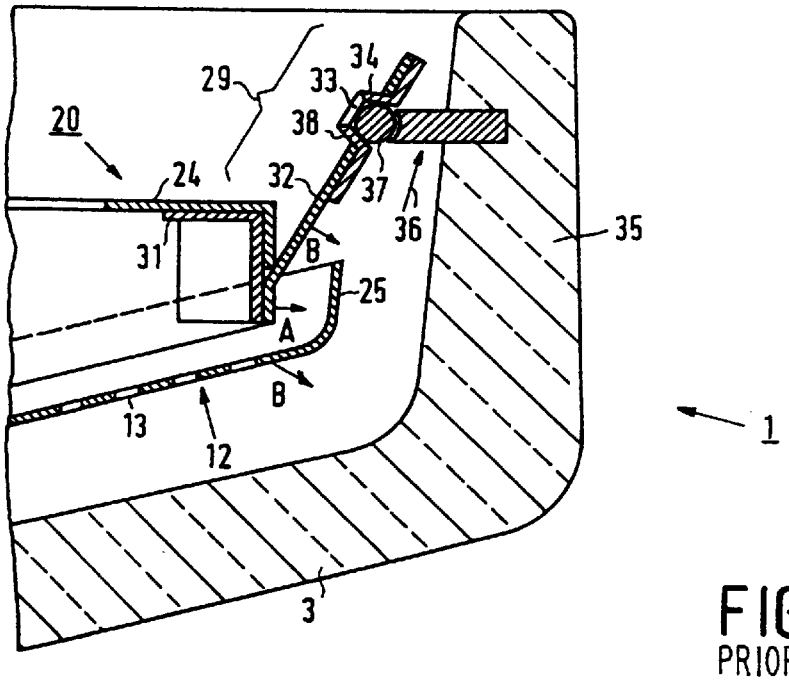
FIG.4 PRIOR ART
FIG. 4 is a sectional view of a detail of a display tube in which a possible manner of suspending the shadow mask in the supporting frame is shown.

FIG. 4 is a cross-sectional view of a corner element and shows a shadow mask 12 which is suspended in front of the display window. The shadow mask 12 is connected to a supporting frame 20 having corner elements 24, such as seen in FIG. 2. The supporting frame 20 is connected to suspension means 29, only one of which is shown in the drawing. In each of the corners there is provided a suspension means. The supporting frame is connected to the shadow mask on the inside of the edges 25 of the shadow mask.

The corner element 24 has a supporting strip 31 to which a suspension means 29 is secured. The suspension means 29 comprises a resilient element 32 having an aperture 33 in which an auxiliary plate 34 is provided. A pin 36 is provided in the wall 35 of the window. The end portion 37 of pin 36 engages in the hollow cone 38 of the auxiliary plate 34. An increase in temperature of the supporting frame 20 causes it to expand in the direction indicated by A. This causes the resilient element and, thus, the shadow mask 12 to move in the direction indicated by B. By virtue thereof the landing displacements, as shown in FIG. 1*b*, are reduced. Such suspension means are known from, for example, U.S. Pat. No. 4,763,039. The suspension means shown in FIG. 1 serves only as an example. In this example as shown in FIG. 4, the expansion of the supporting frame 20 determines the movement of the resilient element 32 and, hence, the movement of the shadow mask and the supporting frame as a whole away from and towards the display screen. Other known suspension means comprise e.g. bimetal elements instead of resilient elements to move the mask-frame combination from and towards the display screen.

DESCRIPTION OF THE INVENTION

The smaller the landing displacements are, the better the picture quality is. The invention aims at reducing the landing displacements in a different manner than that shown in FIGS. 1–4.

The invention is based on the insight that the supporting frame need not be a rigid construction and that the distance between the shadow mask and the display screen can be made temperature-dependent in an alternative manner if the centers of the sides of the supporting frame move relative to the corners of the supporting frame as a function of temperature and if the shadow mask follows this movement.

Hereinafter a few examples are given of the invention based on this insight.

FIG. 5*a* is a side view of a shadow mask which can suitably be used for a display tube according to the invention. One side 22 of the supporting frame 20, for example is provided with a slit 41. Such a side 22 and its corresponding edge 25 of the shadow mask 12 are interconnected by means of two connection points 42, in this example two welding points. Since side 22 is provided with slit 41, the side has a weakened portion between these points, so that side 22 is bendable between points 42 in the direction C transversely to the plane of shadow mask 12. Bending of the side and each of the sides takes place as follows. If the supporting frame and the shadow mask have a substantially equal thermal expansion, the width of slit 41 remains the same when the temperature changes. If there is a difference in thermal expansion, however, the distance between points 42 is determined by the expansion of the shadow mask when the temperature changes. The reason for this is that the mechanical strength of the shadow mask between points 42 is greater than the mechanical strength of side 22. In this example, side 22 bends about hinged joint 43 at the end of slit 41. This causes side 22 to bend. Substantially no thermal stresses occur in the shadow mask. The shadow mask does not deform. The slit 41 between points 42 becomes narrower. In this connection, point 43 above the slit acts as a hinged joint. Below "hinged joints" are used to indicate parts of the sides which act as a hinged joint. Side 22 exhibits a small degree of deflection relative to the corners. Consequently, if the shadow mask exhibits a smaller degree of expansion than the side, point 43 is caused to move relative to the ends of side 22 in the direction C transversely to the plane of the shadow mask. If side 22 of the supporting frame expands less than the shadow mask, the point moves in the opposite direction. The overall movement of point D of the shadow mask is the sum of the movement caused by the bending of all of the sides of the support frame and the movement of the resilient elements 32. The favourable distance between the connection points 42 depends on the construction of the suspension means, the length of the side and the location of the hinged joint. In general, the most favourable distance between the connection points is in the range between 30 and 50 mm.

The next example illustrates the improvement in landing displacement obtained by means of the invention. If the shadow mask is uniformly irradiated by the electron beams, so-called "overall doming" occurs, as explained hereinbefore (see FIG. 1*b*). Doming is measured as a displacement of the point where an electron beam is incident on the display screen relative to the original point where the electron beam is incident on the display screen when the colour display tube is put into operation, and it is expressed in $\mu$m. In an experiment carried out on a 41 cm rectangular colour display tube comprising suspension means of the type shown in FIG. 4 and a shadow mask and a rigid supporting frame, both made of invar which is a material having a low coefficient of thermal expansion, the following overall doming values (measured after irradiating the shadow mask for 1 hour with an electron beam having a current intensity of 1 mA) were found:

I. in the comers of the display window: 9 $\mu$m,

II. at points situated on the diagonal of the display window at a distance from the center of the display window of ⅓ of the length of the diagonal: 15 $\mu$m, III. at the ends of the short axis: 19 $\mu$m and IV. at points situated on the short axis at a distance from the center of the display window of ⅓ of the length of the short axis: 17 $\mu$m.

After replacing the short sides of the supporting frame by iron bendable sides of the type shown in FIG. 5, overall doming for points I, II, III and IV was 14 $\mu$m, 5 $\mu$m, 16 $\mu$m and 1 $\mu$m, respectively. This clearly shows that overall doming is substantially reduced, in particular, in points IV. A reduction in points IV is important, in particular, for colour cathode ray tubes having an in-line electron gun and comprising a phosphor pattern composed of triplet-containing lines which extend approximately parallel to the short axis.

A further advantage is that also ambient doming is reduced. Ambient doming is brought about by the fact that a change in ambient temperature causes the temperature of the colour display tube as a whole to change.

A further advantage was that the cost price of the colour display tube was reduced because iron is cheaper than invar.

Further, the change of the distance between the shadow mask and the display screen caused by bending of the sides of the support frame depends on the way in which the sides bend and on the manner of connecting the shadow mask to the sides, and this change is variable within certain limits. Therefore, the change of the distance between the shadow mask and the display window brought about by the suspension means and, thus, the construction of the suspension means is also variable within certain limits. This enables equal suspension means to be used for different designs of cathode ray tubes.

FIGS. 5*b* and 5*c* show a few further examples of a detail of a colour display tube according to the invention. In FIG. 5*b*, a side 22 of a supporting frame is provided with two grooves 41*a* and 41*b*. Two hinged joints 43*a* and 43*b* are formed in side 22. The disadvantage of such an embodiment relative to the embodiment shown in FIG. 5*a* is that two grooves must be made. The advantage is that the deflection is distributed over two hinged joints.

In FIG. 5*c*, the part of the edge 22 between the points 42 is pleated from point 45. Such an embodiment is more difficult to manufacture than an embodiment as shown in FIG. 5*a*, but it has a greater strength in a direction transversely to the edge.

FIG. 6 shows a detail of a further embodiment of a support frame for a display tube according to the invention. The edge 25 and side 21 are interconnected in the vicinity of the suspension means and at some distance from points 42 via a flexible connection 51. If the shadow mask 12 is connected directly to the supporting frame at these points, the difference in thermal expansion may cause thermal stresses in the shadow mask which may lead to deformation of the shadow mask. The flexible connection 51, in this example a flexible strip, ensures that this does not happen. The flexible connections 51 improve the connection of shadow mask 12 in supporting frame 20. A line I through the points connecting the flexible connection 51 with the shadow mask and with the supporting frame extends preferably at an angle α to the perpendicular to the plane of the shadow mask. A difference in thermal expansion between the side and the supporting frame causes point J to move in the direction indicated by K. As a result thereof, the connection point L between flexible strip 51 and shadow mask 12 moves in a direction M parallel to the direction indicated by C. The flexible connection acts as a lever. By virtue thereof, the movement of point L of the shadow mask in a direction indicated by M can be controlled. In this example, the thermal expansion of the supporting frame exceeds the thermal expansion of the shadow mask. The movement of point L is the sum of the movement caused by the corner suspension elements, the movement caused by the pivoting of side 21 about point 43 and the movement caused by the difference in expansion between the points 42 and 42. By virtue thereof the movement of the shadow mask caused by the heating up of the shadow mask can be accurately controlled without the occurrence of thermal stresses and deformations in the shadow mask. In general, the angle α ranges between 40 and 60 degrees.

Two or preferably four sides of the support frame can be bendable and connected to the shadow mask in the manner shown.

It will be obvious that within the scope of the invention many variations are possible to those skilled in the art. For example, edge 25 of shadow mask 12 can be directly connected to side 22. However, points 42 may also be interconnected by a strip of a material used for the manufacture of the shadow mask, the shadow mask in turn being secured to this strip. Since, in such an embodiment, the thermal expansion of such a strip is equal to the thermal expansion of the shadow mask, the distance between points 42 is determined by the thermal expansion of the shadow mask.

FIG. 7 shows a further variation within the scope of the invention:

Upper side 91 of side 22 is modified. Portion 92 is made of a material having a coefficient of expansion which differs from that of the rest of side 22. Portion 92 is made of, for example, invar, whereas portion 91 is made of iron. When the temperature increases, side 22 bends, thereby causing groove 93 in the front side 94 of side 22 to open. The edge of the shadow mask (not shown) is secured to side 22 at point 95.

Further variations are, inter alia,:

sides provided with a large number of slits;

sides whose upper edges consist of two layers having different coefficients of expansion.

FIG. 8 shows a further embodiment of the colour display tube according to the invention. Side 101 and shadow mask 102 are made of iron. A connection element 103 which is made of a material having a different coefficient of expansion, in this example a strip of invar, is situated between the shadow mask and the side. The strip is secured to this side at two points 104 located on either side of groove 105. The shadow mask is secured to the strip at point 106. When the temperature rises the strip causes the side to bend and the shadow mask moves relative to the corners of the supporting frame FIG. 9 shows a rectangular support frame 120 having the structure of each side, such as individually shown in FIG. 8, where the shadow mask has apertures 113 and the corner elements 124 have suspension elements 119. The connection elements 103 of invar, as shown in FIG. 8, lie between the shadow mask 102 and sides 103 of the supporting frame. Due to the difference in thermal expansion between iron and invar, the connecting elements 103 cause the side portions 101 of the support frame to bend.

I claim:

1. A color display tube comprising an electron gun for generating electron beams, a display screen for receiving said electron beams, a shadow mask disposed between said electron gun and said display screen, and a four-sided supporting frame for holding said shadow mask, the improvement comprising means associated with said supporting frame for preventing deformations of said shadow mask during operation of the display tube.

2. A color display tube according to claim 1, wherein said means include at least one pair of oppositely located sides of said supporting frame, said at least one pair bending with temperature increases, and wherein said means causes such thermal bending to change distances between said shadow mask and said display screen without deforming said shadow mask.

3. A color display tube according to claim 2, wherein each of said pair of sides has a value of thermal expansion differing from the thermal expansion value of said shadow mask, wherein each of said pair of sides is connected to said shadow mask in at least two connection points, said connection points being disposed on opposing sides of a centerline through a position of said each of said pair of sides transverse to the plane of said shadow mask, said connection points being disposed in a second plane approximately parallel to said shadow mask, and wherein each of said pair of sides has a weakened portion between said connection points, each of said sides being bendable at said weakened portion in a direction transverse to said plane of said shadow mask by said temperature increases.

4. A color display tube according to claim 3, wherein each of said pair of sides is elastically bent by a connection element having a different coefficient of expansion from the coefficient of expansion of each of said pair of sides, said connection element being disposed between each of said pair of sides and said shadow mask.

5. A color display tube according to claim 4, wherein a slit is disposed to extend in the center of each of said pair of sides, and a hinged joint is disposed at one end of said slit at a distance from said second plane.

6. A color display tube according to claim 5, wherein said shadow mask and each of said pair of sides are interconnected on either side of said centerline and at a distance from said connection points by flexible connections.

7. A color display tube according to claim 6, wherein said flexible connections move said shadow mask relative to each of said pair of sides in a direction transverse to said plane of said shadow mask.

8. A color display tube according to claim 3, wherein a slit is disposed to extend in the center of each of said pair of sides, and a hinged joint is disposed at one end of said slit at a distance from said second plane.

9. A color display tube according to claim 3, wherein said shadow mask and each of said pair of sides are interconnected on either side of said centerline and at a distance from said connection points by flexible connections.

10. A color display tube according to claim 4, wherein said shadow mask and each of said pair of sides are interconnected on either side of said centerline and at a distance from said connection points by flexible connections.

11. A color display tube according to claim 1, wherein said means for preventing deformation of said shadow mask includes all four sides of said supporting frame.

12. A color display tube comprising an electron gun for generating electron beams, a display screen for receiving said electron beams, a shadow mask disposed between said electron gun and said display screen, and a four-sided supporting frame for holding said shadow mask, the improvement comprising that for at least one pair of oppositely located sides of said supporting frame, positions of centers of said sides relative to corners of said supporting frame are temperature dependent to prevent deformations of said shadow mask during operation of the display tube.

* * * * *